United States Patent [19]

Milvik

[11] 4,250,999

[45] Feb. 17, 1981

[54] TEAR-OFF FLANGE FOR AN ARTICLE

[76] Inventor: Michael Milvik, 56 Geelong St., East Brisbane Old 4169, Australia

[21] Appl. No.: 662,419

[22] Filed: Mar. 1, 1976

[30] Foreign Application Priority Data

Mar. 5, 1975 [AU] Australia ..... PC0787

[51] Int. Cl.[3] ..... B65D 27/34

[52] U.S. Cl. ..... 206/610; 229/92.1

[58] Field of Search ..... 229/73, 85, 92.1, 92.7, 229/92.3; 206/610

[56] References Cited

U.S. PATENT DOCUMENTS

| | | | |
|---|---|---|---|
| 190,478 | 5/1877 | Ehrlich | 229/92.7 |
| 304,661 | 9/1884 | Pedrick | 229/92.1 |
| 683,796 | 10/1901 | Reach | 229/92.7 |
| 1,317,537 | 9/1919 | Altoonian | 229/92.7 |
| 1,344,071 | 6/1920 | Webster | 229/85 X |
| 3,498,528 | 3/1970 | Klein | 229/73 |
| 3,627,196 | 12/1971 | Smith | 229/85 |

*Primary Examiner*—Stephen P. Garbe

[57] ABSTRACT

A letter sheet includes a body portion which is foldable about itself so as to form at least two intermediate panels positioned between a pair of outer panels. Removable flange portions extend along and are detachably secured to the edges of the body portion which constitute the outer panels. The body portion is provided with a line of perforation along substantially the entire length of the edges of the outer panels. At least one of the removable portions on one of the outer panels is adapted to overlie the corresponding removable flange portion of the other of the outer panels when the sheet is in its folded condition. Connector means are associated with the removable flange portions for joining the overlying flange portions to thereby seal the folded letter sheet for postage. The body portion is dimensioned such that its opposed outer edges of the segment to be formed into the intermediate panels project outwardly beyond the line of perforations to constitute extensions which overlie the line of perforations when the letter sheet is in its folded condition. The body portion extensions terminate inwardly of the outer edge of the flange portions. The flange portions may thus be gripped outwardly of the body portion extensions so as to facilitate removal thereof by tearing along the line of perforations. The body portion extensions, in overlying the line of perforations, serves to strengthen the sealed letter sheet along such line of perforations.

4 Claims, 6 Drawing Figures

TEAR-OFF FLANGE FOR AN ARTICLE

This invention relates to a tear-off flange assembly for an article and in particular it relates to such a flange assembly providing the closure arrangement of an air-letter.

Many articles are adapted to be opened by removing a flange portion by tearing along perforations provided for that purpose. While such tear-off flanges are very convenient, their use in many instances has been restricted because of the vulnerability of the removable flange, which may be accidentally removed by rough or careless handling.

The present invention arose through the desire to provide an air-letter having the convenient feature of being able to be opened by removing a tear-off edge flange along perforations provided for that purpose. While it has been possible to devise a foldable letter blank incorporating tear-off edge flanges for opening the concealed letter and having advantageous features over the currently available air-letters, it was further desired to provide such tear-off flanges which would not be liable to be removed accidentally through rough handling or through passage through mail sorting apparatus. The present invention now provides such means for reinforcing the perforations while still achieving the desired easy opening and other features.

Accordingly, the present invention resides in one aspect in a tear-off flange assembly removable for separating first and second sheet-like parts of an article, said parts being operatively joined by said flange assembly which is constituted by a pair of side flaps in register and operatively joined along a common edge remote from said parts and adapted for separation from said parts along perforations forming the junction between said flaps and said sheet-like parts, and an interleaving sheet-like part between said flaps adapted to overlie said perforations to reinforce same.

In another aspect, the present invention resides in a substantially rectangular air-letter blank arranged to fold about orthogonal centre lines into overlying quarters, characterised in that there is provided along the two free edges of each of a pair of adjoining quarters, integral flaps extending outwardly from perforations provided along the respective edges, said flaps, when said letter is folded into quarters in such manner that said adjoining quarters are outermost, being connectible together to seal said folded air-letter, the latter thereafter being able to be opened by tearing-off said flaps along said perforations.

In order that the invention may be more readily understood and put into practical effect reference will now be made to the accompanying drawings which illustrate the invention as applied to envelopes. Of course, the invention may be applied to other enclosure articles apart from paper articles of the envelope type.

Figure 3:
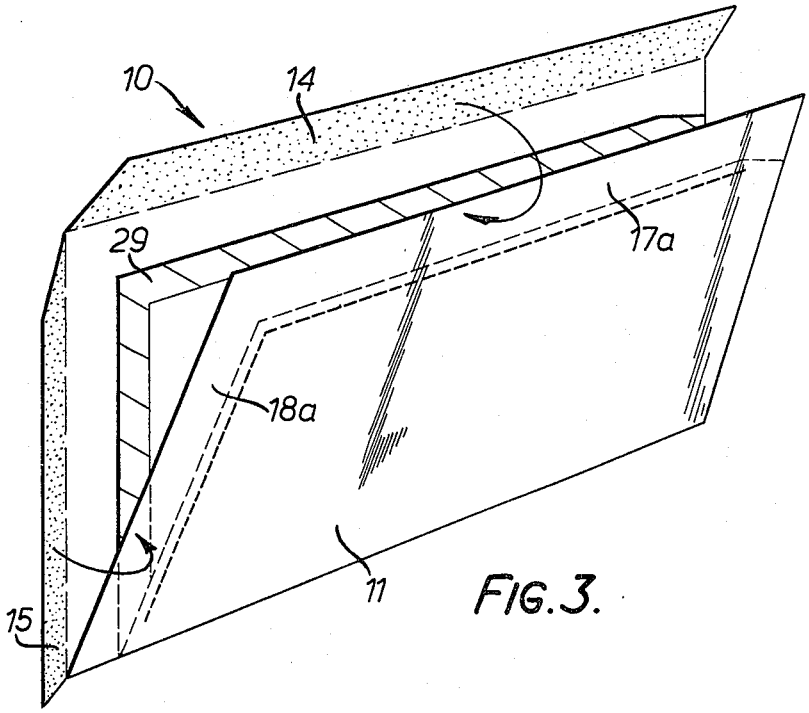
FIG. 3 is a perspective view showing the arrangement of an air-letter prior to being sealed.
Figure 4:
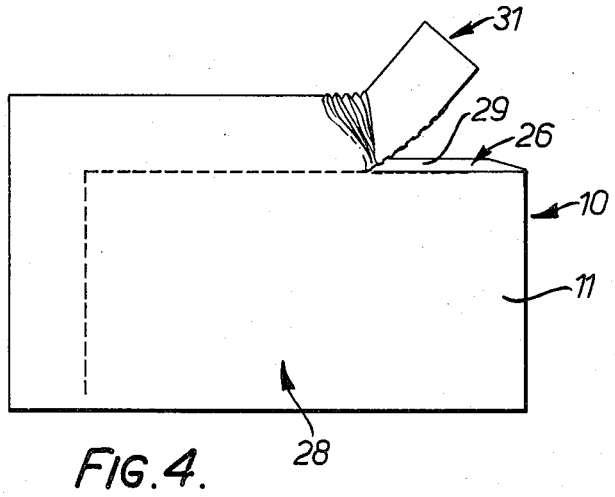
FIG. 4 illustrates the air-letter in part open attitude.

In the abovementioned drawings, perforations are shown in dotted outline and fold lines are shown as light dashed outlines. Furthermore, for ease of understanding, in FIG. 3, ghost outline is used to indicate concealed parts of the air-letter.

Figure 1:
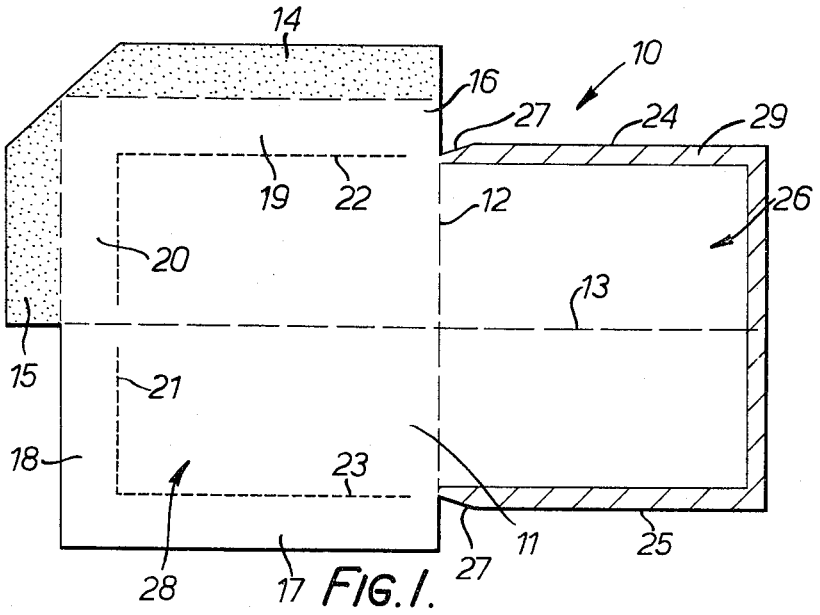
FIG. 1 illustrates the preferred form of air-letter blank according to the present invention.

As shown in FIG. 1, the air-letter 10 according to the invention includes a substantially rectangular body portion 11 which is adapted to be folded into quarters along a first fold line 12 for reducing the body portion by halves, and a second fold line 13 for reducing the body portion to quarter size. As shown, there are provided gummed flange portions 14 and 15 about the free edges of the flanges of the principal quarter 16 of the body portion 11 into which the remaining quarters are adapted to be folded, whereupon as shown n FIG. 3, the gummed flanges 14 and 15 may be wet, folded down to adhere to the back faces 17*a* and 18*a*, respectively, of the removable flange portions 17 and 18, these flange portions 17 and 18 being, when folded, in register with the flange portions 19 and 20 of the principal quarter 16.

As shown in FIG. 1, the flanges 17, 18, 19 and 20 are formed by orthogonal perforations 21, 22 and 23, 22 and 23 of which are continuations of the side edges 24 and 25 of the minor half 26.

Figure 2:
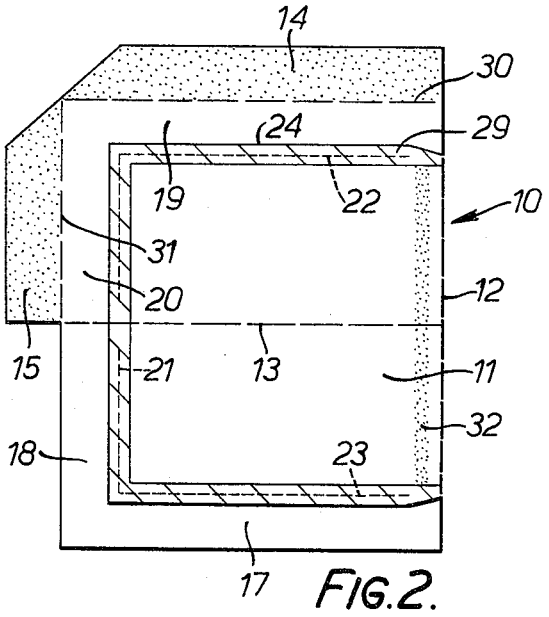
FIG. 2 illustrates the air-letter blank in part folded attitude.

The side edges 24 and 25 are stepped outwards at 27 so that when the minor quarter 26 is folded about the fold line 12 to lie in register with the major half 28, the shaded edge area 29 which extends around the free sides of the minor half 26 will overlie the perforations 21, 22 and 23, as shown in FIG. 2. This feature is provided so that in the cross-section along the lines of the perforations, the weakness caused by the perforations for opening purposes is reinforced by the continuous sheets formed by the edge portion 29 of the folded minor half 26. Thus, it will be seen that the shear strength of the envelope at the perforations is greatly increased so that the chance of accidental opening of the letter is reduced.

As will be clearly seen from FIG. 2, the portion 29 overlying the perforations 21, does not extend outwards to the fold lines 30 and 31 defining the gummed portions 14 and 15, respectively. Thus, in use, the operatively joined flanges 17 and 19 and flanges 18 and 20 may be gripped for removal purposes without gripping the edge area 29 which overlies the perforations defining the flanges 17, 18, 19 and 20. Thus, while the interleaving sheets formed by the folded minor half 26 reinforce the shear strength of the air-letter along perforations 19, they do not increase the difficulty of removing the discardable portion 31 which may be gripped along the length thereof to facilitate easy and clean removal along the perforations, provided that the latter is removed by grasping remote from the edge area 29 and tearing in the direction away from the body of the letter. This action requires only the tearing of the flange area between the slots forming the perforations. It will be seen from the drawings that the perforations do not extend right to the end of the letter and at this area the reinforcing area 29 is cut away. This accidental tearing at the edge is not likely, because of the lack of perforations, and opening is not hindered by the area 29 forming an obstruction. Furthermore, the perforations may terminate short of the longitudinal centre line as shown, for the same purpose.

An additional feature of the above-described air-letter is that once a flange portion 31 has been removed there remains a substantially rectangular sheet of paper of which one full side and one-half side may contain the message which is concealed during transit. An additional feature is the provision of press-to-seal or equivalent gummed strips 32 along the folded edge 12 so that in use, the letter is completely sealed about two edges by the removable flange assembly, one edge by the gummed strips 32 and the remaining edge by the fold of the article.

Figure 5:
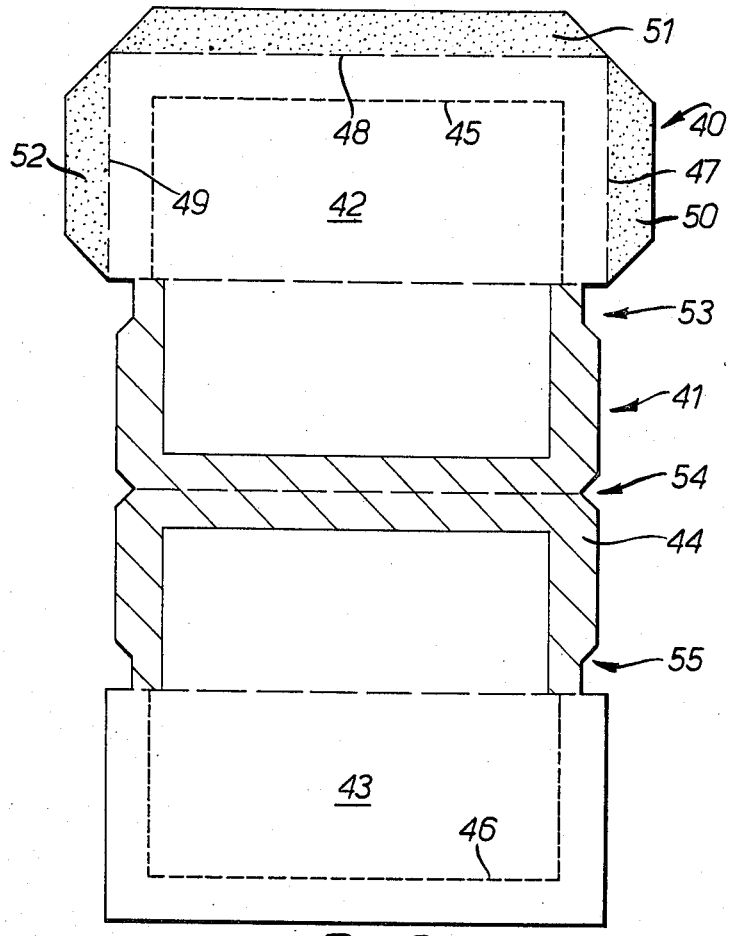
FIG. 5 illustrates an alternate form of air-letter having advantageous features of the present invention.
Figure 6:
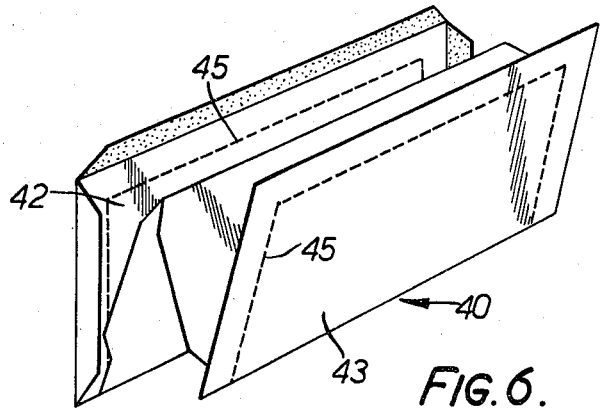
FIG. 6 is a perspective view of the air-letter illustrated in FIG. 5 in part folded attitude.

In an alternate form of an air-letter 40 or the like illustrated in FIGS. 5 and 6, the centre portion 41 is adapted to be folded in a concertina arrangement between the major side portion 42 and the minor side portion 43. As per the previous embodiment, there are provided gummed flaps along the flanges of the major side 42 for operatively joining the flaps of the respective sides of the major and minor side portions 42 and 43, respectively. In this embodiment, the shaded area 44 represents the reinforcing portion which overlies the perforations 45 and 46 which are adapted to lie in register in use. To enable the removable flap part to be easily removed in use there are provided cut-outs 53, 54 and 55 in each side of the centre portion, which cut-outs correspond to a corner of the flange at which point the letter may be gripped without gripping the reinforcing part for removal of the flange.

While the invention has been illustrated with reference to air-letters, of course it can be applied to any enclosure article having a pair of normally connected sheet-like parts, the latter according to the present invention being adapted to be connected by a flange assembly as described above. Furthermore, in an air-letter or like article, the overlying reinforcing strip need not necessarily be in the form of an edge of an integral fold-in sheet and could be, for example, a separate strip glued to either the removable flange or the article adjacent the perforations. Thus in one aspect this invention provides an easy opening air-letter. In another aspect, the invention provides a reinforced flange assembly for an article. In another aspect, the invention provides an air-letter having easy opening qualities and reinforcement of the opening flange.

It will, of course, be realised that while the above has been given by way of illustrative example, many modifications of constructional detail and design as would apparent to persons skilled in the art could be made to the above described embodiment. However, such arrangements are deemed to fall within the broad scope and ambit of the invention as is defined by the appended claims.

I claim:

1. A one piece letter sheet comprising a body portion foldable about a first orthogonal line to form two sections and about a second orthogonal line to divide said sections to form two intermediate panels positioned between a pair of outer panels; said outer panels having removable flanges extending along the outer peripheral edges thereof, a line of perforations separating each of said removable flanges from its associated outer panel to permit said removable flange to be detached therefrom, the removable flanges of one of said outer panels overlying the corresponding removable flanges of the other of said outer panels when the sheet is in its folded condition, manually sealable connector means associated with each set of overlying removable flanges, said connector means being integral with one of the removable flanges of each pair and foldable over the other removable flange in the pair, to thereby seal the folded letter sheet for postage, the peripheral edge portions of said intermediate panels being imperforate and projecting when the sheet is folded outwardly in a fixed manner beyond said line of perforations so as to constitute extensions which overlie said line of perforations and terminating inwardly of the outer edge of the said removable flange portions, said extensions being interposed between each set of removable flanges and serving to strengthen the sealed letter sheet along said lines of perforations, permitting said removable flange portions to be gripped outwardly of said extensions for removal along said line of perforations.

2. A letter sheet according to claim 1, wherein said connector means is constituted by a gummed flange formed as an extension of the removable flange of one of said outer panels and is adapted to be folded for adhesive connection to said corresponding flange of said other outer panel.

3. A letter sheet according to claim 1, wherein the peripheral edge portions of the intermediate panels adjacent the center line about which said letter sheet is first folded are cut away so as not to extend beyond said line of perforations when said letter sheet is sealed.

4. A letter sheet according to claim 1, wherein said letter sheet is adapted to be folded into halves about its transverse center line and then into quarters about its longitudinal center line and wherein there are provided pressure sensitive gummed strips along the inner edge portions of the folded letter sheet adjacent said transverse center line.

* * * * *